United States Patent [19]

Corella

[11] Patent Number: 4,886,373

[45] Date of Patent: Dec. 12, 1989

[54] SELF-SUPPORTING, FLEXIBLE, DISPENSING PACKAGE

[76] Inventor: Arthur P. Corella, 8166 Vanscoy, North Hollywood, Calif. 91602

[21] Appl. No.: 85,776

[22] Filed: Aug. 17, 1987

[51] Int. Cl.[4] ..... B65D 5/50

[52] U.S. Cl. ..... 383/104; 383/38; 53/409; 53/479

[58] Field of Search ..... 383/104, 38; 53/409, 53/457, 479

[56] References Cited

U.S. PATENT DOCUMENTS

| | | | |
|---|---|---|---|
| 2,718,105 | 9/1955 | Ferguson et al. | 383/104 |
| 3,437,258 | 4/1969 | Kugler | 383/104 |
| 4,361,235 | 11/1982 | Gautier | 383/104 |
| 4,394,955 | 7/1983 | Raines et al. | 383/104 |
| 4,718,738 | 1/1988 | Bell | 383/104 |

*Primary Examiner*—Joseph Man-Fu Moy
*Attorney, Agent, or Firm*—Donald Diamond

[57] ABSTRACT

A self-supporting, stand-up, peripherally sealed, flexible, dispensing pouch has a construction which comprises (a) a circumferential, flexible wall that defines a compartment which contains fluidic material; (b) an inverted portion of the flexible wall that extends into the compartment; and (c) a self-supporting rim formed by the confluence of the flexible wall with the inverted portion. The self-supporting, stand-up, dispensing pouch is prepared from a lay-flat, dispensing pouch that is partially filled with fluidic material and wherein the remaining space in the pouch has a reduced vapor pressure, by displacing a substantial portion of the fluidic material contained in a first portion of the pouch to the remaining second portion of the pouch and while maintaining the fluidic material in the pouch second portion, inverting the pouch wall overlying the second portion into the pouch first portion to form an inverted portion, whereby the confluence of the pouch wall with the inverted portion forms a self-supporting rim for upright support of the pouch.

20 Claims, 2 Drawing Sheets

SELF-SUPPORTING, FLEXIBLE, DISPENSING PACKAGE

BACKGROUND OF THE INVENTION

1. Field of the Invention

This invention relates to flexible dispensing packages and, more particularly, to flexible dispensing packages having a self-supporting, stand-up configuration.

2. Prior Art

The packaging of liquid and dry products in heat sealable, dispensing enclosures by high-speed production techniques and equipment is a well-developed art. The heat sealed, packaged product is generally referred to as having a form-fill-seal construction and is sometimes characterized as a form and fill package. These packages may have a rectangular pouch configuration or other special shape and construction. As to the pouch configuration, there are three basic forms, which are known as the pillow type, three-side seal and four-side seal. The pillow type is constructed from one web and is provided with top and bottom seals and a vertical seam which can take the form of a fin seal or a lap seal. The three-side seal is constructed from one web and is provided with a fold along one side and seals along the remaining three sides. The four-side seal is constructed from one or two webs and is provided with bottom, side and top seals. The web used in the construction of heat sealable packages can take the form of a single layer or a multi-layer laminate. In either form, the oppositely disposed sealable faces comprise heat sealable thermoplastic material such as polyethylene, polypropylene or the like. In the laminate configuration, the inner layer is, for example, polyethylene and the outer layer can be cellophane, paper, polyester, metalized polyester, aluminum foil or the like. A heat sealable laminate comprising three or more layers is sometimes designated as a laminate having a sandwich construction or configuration.

The form and fill package, with a rectangular pouch configuration, is generally referred to as a lay flat or envelope package because neither the top nor the bottom nor either side provides a base for up-right support of the package and, therefore, when the package is placed on a horizontal surface either the front or rear panel of the package engages the horizontal surface in an ostensibly lay flat manner.

Although the form and fill, lay flat package provides significant production and economic benefits to the producer, a major disadvantage to the consumer arises when the package is opened and less than the total contents of the package are dispensed. When the partially empty and open, lay flat, package is placed on a horizontal surface, a significant portion of the remaining fluidic material can flow out of the package through the tear-open aperture.

The prior art has sought to overcome the spill-out characteristics of lay-flat packages and to provide stand-up, flexible packages analogous to bottles, cans and paperboard cartons by developing form and fill and related flexible packaging that incorporates a base which permits the package to stand up-right on a support surface.

U.S. Pat. No. 3,051,368 (W. S. Schneider, et al., 1962) discloses a flexible wall, dispensing container provided with a base that is defined by multiple edges lying in a common plane.

U.S. Pat. No. 3,387,701 (W. S. Schneider, et al., 1968) discloses a flexible wall, dispensing container incorporating a mechanically formed and thermally set flat base.

U.S. Re 27,302 (W. S. Schneider, et al., 1972) discloses a mechanical and thermal method for converting the lower, sealed end of a form and fill package to a flat base.

U.S. Pat. No. 3,432,986 (W. S. Schneider, et al., 1969) discloses a packaging machine of the form and fill type for producing a flexible wall, dispensing container incorporating a mechanically formed and thermally set flat base.

U.S. Pat. No. 3,354,601 (W. S. Schneider, et al., 1967) discloses a method for making a stand-up, flexible wall, dispensing container which includes the step of attaching a flexible tubular film to a base.

U.S. Pat. No. 3,380,646 (L. Doyen, et al., 1968) discloses a self-supporting pouch type container wherein the lower end portion of the container incorporates a gusset construction that diverges outwardly to form an elliptical product support base upon the addition of fluidic material to the container.

U.S. Design Pat. Nos. 200,553 (A. P. Corella, et al., 1965); 200,554 (A. P. Corella, et al., 1965); 205,635 (A. P. Corella, et al., 1966); and 208,272 (A. P. Corella, et al., 1967) disclose diverse designs for flexible wall, dispensing containers having flat bases.

The thin wall, flexible packaging of the prior art includes special folds and heat seals, developed by special purpose equipment, to provide a base for up-right support. It would, of course, be advantageous to provide a form and fill package which has stand-up capability, but which does not require special folds and heat seals for this purpose.

SUMMARY OF THE INVENTION

In accordance with one aspect of this invention, there is provided a peripherally sealed, flexible, dispensing package having a self-supporting, stand-up configuration. The package comprises: (a) a circumferential, flexible wall that defines a compartment which contains fluidic material; (b) an inverted portion of the flexible wall that extends into the compartment, and (c) a self-supporting rim formed by the confluence of the flexible wall with the inverted portion.

In accordance with a second aspect of this invention, there is provided a method for converting a peripherally sealed, lay flat, flexible, dispensing package to a self-supporting, stand-up configuration. The convertible, dispensing package includes a circumferential, flexible wall that defines a compartment which contains fluidic material in an amount from about 50 to about 80% of the volume of the compartment with the remaining volume of the compartment having a vapor pressure below atmospheric pressure, and the compartment includes first and second portions with the fluidic material being disposed in the first portion. The method comprises: (a) displacing a substantial amount of fluidic material from the first portion of the compartment to the second portion of the compartment; and (b) while maintaining the fluidic material in the second portion, inverting into the compartment the flexible wall overlying the second portion and longitudinally opposite the first portion to form a inverted portion, whereby the confluence of the flexible wall with the inverted portion forms a self-supporting rim for up-right support of the package.

The flexible wall of the peripherally sealed, dispensing package includes an inner face of heat sealable material as, for example, polyethylene and an outer face, with opposing portions of the inner face being heat sealed within the area of the peripheral seal. The outer face of the flexible wall can comprise cellophane, paper, plastic such as polyester, metalized plastic or aluminum foil, with the selection of the sheet or laminate and the thickness thereof being based on the nature of the fluidic material to be packaged. The flexible wall, dispensing package can be constructed from a pair of superimposed sheets, from a single sheet folded in a manner to provide a pair of superimposed sheets, and from a single sheet circumscribed in a manner to provide a pillow configuration.

Diversified fluidic materials having flowable characteristics can be used in the practice of this invention. The fluidic materials can be in either liquid or dry form. Illustrative fluidic materials in dry form include flowable powders and granules. Illustrative fluidic materials in liquid form include (a) consumable products such as dessert toppings, salad dressing, condiments and the like, and (b) external body care preparations such as hair care and skin care products.

DETAILED DESCRIPTION

Figure 1:
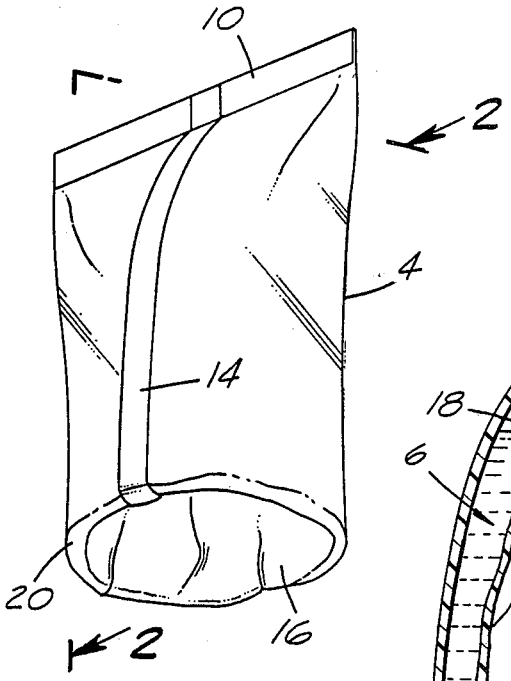
FIG. 1 is a perspective view of a self-supporting, stand-up, flexible pillow-pack type, dispensing package showing the support rim formed by the confluence of the flexible package wall with the inverted portion of the package.
Figure 2:
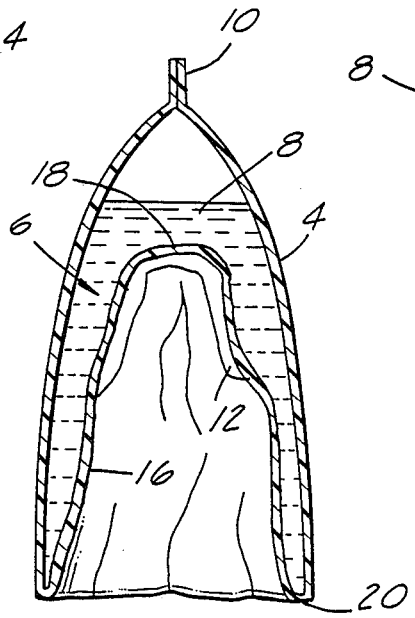
FIG. 2 is a partially schematic, longitudinal section taken along line 2—2 of FIG. 1 and shows the inverted portion of the package together with the surrounding fluidic material.

Referring now to the drawings and, in particular, to FIG. 1, there is shown a peripherally sealed, self-supporting, stand-up, flexible, pillow-pack type, dispensing package having a flexible, circumferential, side wall 4 that defines a compartment 6 which contains a fluidic material 8 (FIG. 2). The stand-up, pillow-pack, dispensing package includes a first end seal 10, a second end seal 12, and a vertical seal 14. An inverted portion 16 of the flexible wall 4 extends into the compartment 6 in the direction of the first end seal 10, with the apex 18 of the inverted portion being proximate to the first end seal. The confluence of the flexible wall 4 with the inverted portion 16 forms a self-supporting rim 20 for up-right support of the package.

A lay-flat, pillow-pack pouch having certain characteristics with respect to fluid content and vapor pressure can be readily converted into a self-supporting, stand-up dispensing package, as hereinafter described. The product characteristics and the method for effecting the conversion are illustrated in FIGS. 3A–3E.

Figure 3A:
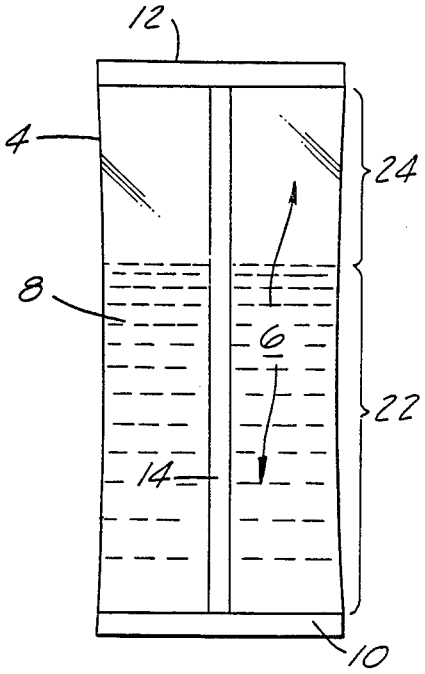
FIGS. 3A through 3D illustrate the steps in the method for converting a peripherally sealed, lay-flat, dispensing package of fluidic material to a stand-up, self-supporting configuration.

Referring to FIG. 3A, there is schematically shown a peripherally sealed, elongated, lay-flat, flexible, pillow-pack dispensing package containing fluidic material. The pillow-pack, dispensing package includes a first end seal 10, and an oppositely disposed second end seal 12, a vertical seal 14 and a circumferential side wall 4 that defines a compartment 6 which is partially filled with fluidic material 8.

The fluidic material is generally present in a first portion 22 of the compartment 6 in an amount from about 50 to about 80% of the volume of the compartment and, preferably in an amount from about 50 to about 65% of the volume of the compartment. The remaining volume of the compartment, namely, the second portion 24 of the compartment 6 advantageously has a vapor pressure below atmospheric pressure and, preferably, substantially below atmospheric pressure.

Form-fill-seal equipment modified to include head space, vapor evacuation means can be used to prepare heat sealed, pillow-pack, dispensing pouches having a selected volume of fluidic material and a reduced vapor pressure.

Figure 3B:
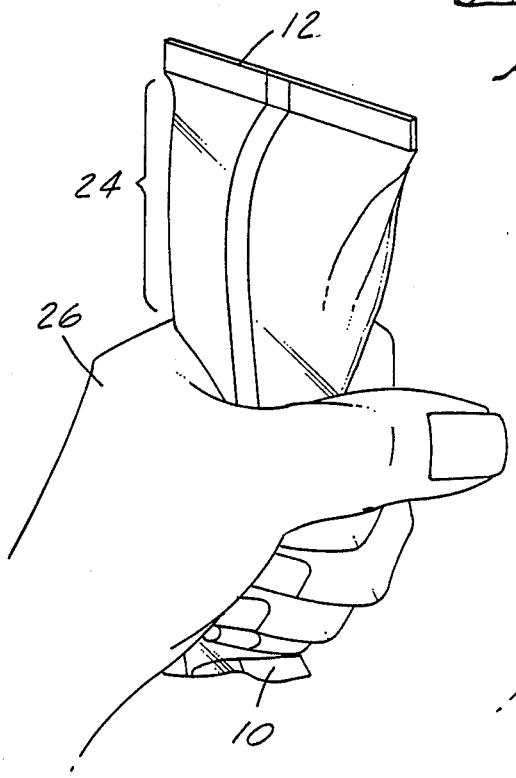
Figure 3C:
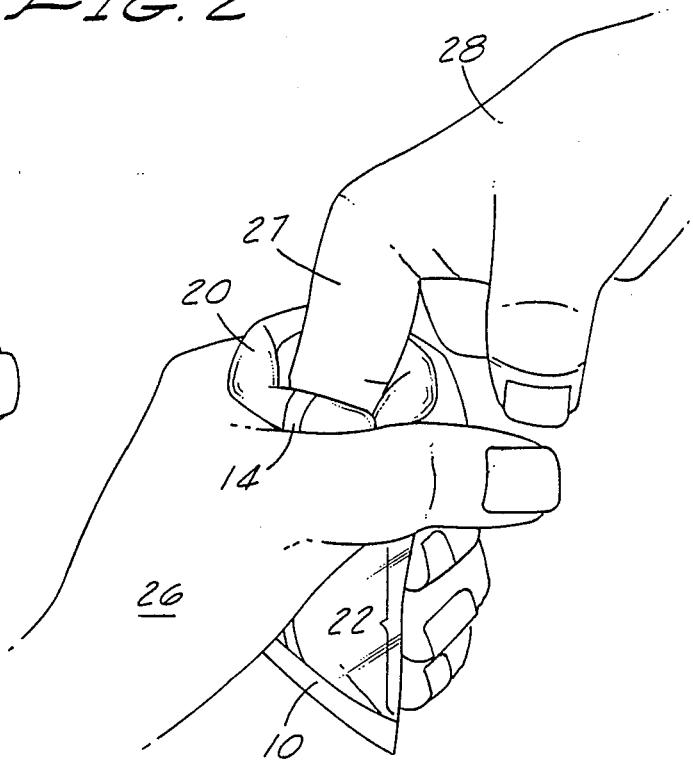
Figure 3D:
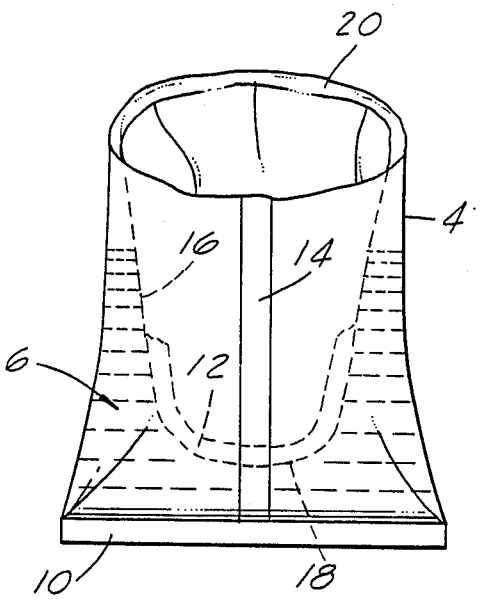
Figure 3E:
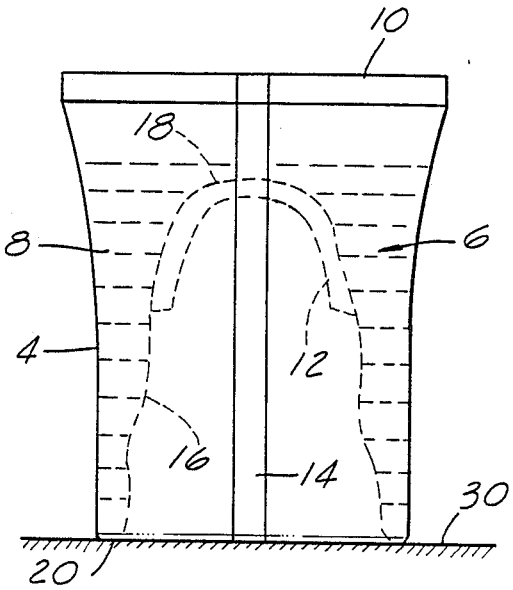

To manually convert the lay-flat, flexible, pillow-pack pouch shown in FIG. 3A to a self-supporting, stand-up configuration, one hand 26 is used to circumferentially grasp and squeeze the first portion 22 of the pouch to thereby force a substantial amount of the fluidic material into the second portion 24 of the pouch as shown in FIG. 3B; and, while maintaining the fluidic material in the second portion 24 of the pouch through the continued application of the aforesaid squeezing force to the first portion 22 of the pouch, a finger 27 from the other hand 28 is longitudinally pressed against the second end seal 12 at the outer end of the bulbular second portion 24 of the pouch as shown in FIGS. 3B and 3C. The force applied by the finger causes the section of the flexible wall overlying the second portion of the pouch to involute and roll into the first portion 22 of the compartment 6 to provide an inverted portion 16 having its apex 18 proximate to the first end seal 10 as shown in FIG. 3D. The confluence of the flexible wall 4 with the inverted portion 16 forms a self-supporting rim 20 for up-right support of the package. If there is any irregularity in the surface or level of the rim, it can be removed by manual smoothing. The finished package can then be oriented to bring its rim 20 into engagement with a support surface 30 to thereby obtain a vertically supportable pillow-pack pouch, as shown in FIG. 3E.

Figure 4:
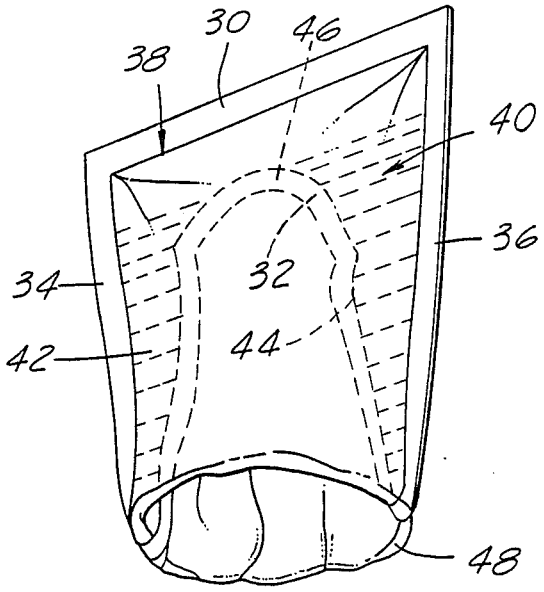
FIG. 4 is a perspective and partially schematic view of a self-supporting, stand-up, flexible, four-side seal type, dispensing package of fluidic material showing the support rim formed by the confluence of the flexible package wall with the inverted portion of the package.

In an alternative packaging embodiment, there is shown, in FIG. 4, a peripherally sealed, self-supporting, stand-up, flexible, four-side seal type, dispensing package. This package includes a first end seal 30, a second end seal 32, a first side seal 34, a second side seal 36, a circumferential flexible wall 38 defining a compartment 40 that contains a fluidic material 42. An inverted portion 44 of the flexible wall extends into the compartment with its apex 46 being proximate to the first end seal 30. The confluence of the flexible wall 38 with the inverted portion 44 forms a self-supporting rim 48 for up-right support of the package.

Figure 5:
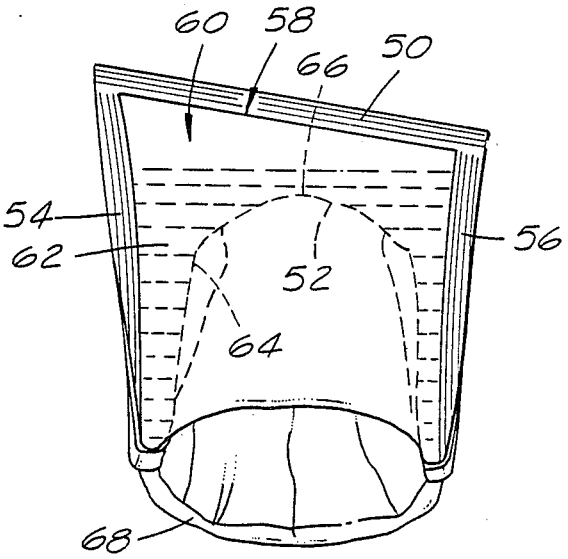
FIG. 5 is a perspective and partially schematic view of a self-supporting, stand-up, flexible, three-side seal type, dispensing package of fluidic material showing the support rim formed by the confluence of the flexible package wall with the inverted portion of the package, and showing the outer end of the package, opposite the rim, having an inclined configuration that is adapted to provide a pour spout.

In a further packaging embodiment, there is shown, in FIG. 5, a peripherally sealed, self-supporting, stand-up, flexible, three-side seal type, dispensing package. This package includes a first end seal 50, an opposite end fold 52, a first side seal 54, a second side seal 56, a circumferential flexible wall 58 defining a compartment 60 that contains a fluidic material 62. An inverted portion 64 of the wall extending into the compartment with its apex 66 being proximate to the first end seal 50. The confluence of the flexible wall 58 with the inverted portion 64 forms a self-supporting rim 68 for up-right support of the package. Also, as shown in FIG. 5, the first end seal 50 is provided with an inclined configuration that is adapted to provide a pour spout.

Lay-flat, flexible, dispensing pouches, including three-side and four-side seal pouches, having a fluid content from about 50 to about 80% of the volume of the pouch and, preferably, from about 50 to about 65% of the volume of the pouch and head space pressure below atmospheric pressure, can be readily converted into self-supporting, stand-up pouches by utilizing the method and procedure hereinabove described with respect to the pillow-pack pouch.

Diversified packaging materials, including sheets and laminates, and a wide variety of fluidic materials can be used in the practice of this invention.

While the procedure for converting a lay-flat, dispensing package to a self-supporting, stand-up configuration has been described with respect to a manual process, this procedure can also be carried out by mechanical means or techniques.

The package and method of this invention constitute a significant advance in the art in that economically produced, form and fill, lay-flat packages can be readily converted to a self-supporting, stand-up configuration whereby a portion of the package contents can be dispensed and the package with its remaining contents can then be placed on a surface in a self-supporting, vertical position.

While in the foregoing description and accompany drawings there has been shown and described the preferred embodiment of this invention, it will be understood, of course, that minor changes may be made in the details of construction as well as in the combination, arrangement, and composition of parts, without departing from the spirit and scope of the invention as claimed.

That which is claimed is:

1. A peripherally sealed, flexible, dispensing package having a self-supporting, stand-up configuration, said package comprising:

(a) a circumferential, outer flexible wall that defines a compartment which contains fluidic material;

(b) an inverted portion of said flexible wall extending into said compartment and defining an inverted inner wall; and (c) a self-supporting rim formed by the confluence of the outer flexible wall with the inverted inner wall, and (d) wherein the outer flexible wall and the inverted inner wall are in spaced relationship and there is no flattening of the inverted portion due to the load of the fluidic material in the self-supporting mode.

2. The dispensing package of claim 1 wherein the package has an elongated configuration and the inverted portion is substantially in longitudinal alignment with the length of the package.

3. The dispensing package of claim 1 wherein the package is a pillow-talk pouch having oppositely disposed end seals and a vertical seal, and the inverted portion is disposed in the direction of one of said end seals.

4. The dispensing package of claim 1 wherein the package is a four-side seal pouch having oppositely disposed end seals and oppositely disposed side seals, and the inverted portion is disposed in the direction of one of said end seals.

5. The dispensing package of claim 1 wherein the package is a three-side seal pouch having oppositely disposed side seals, an end seal and an oppositely disposed end fold, and the inverted portion is disposed in the direction of an end of said package.

6. The dispensing package of claim 1 wherein the package is a three-side seal pouch having oppositely disposed end seals, a side seal and a folded side, and the inverted portion is disposed in the direction of one of said end seals.

7. The dispensing package of claims 3, 4, 5 or 6 wherein the outer end of the package, opposite said self-supporting rim, has an inclined configuration that is adapted to provide a pour spout.

8. The dispensing package of claim 1 wherein the flexible wall has an inner face of heat sealable material and an outer face.

9. The dispensing package of claim 8 wherein the outer face comprises cellophane paper, plastic, metalized plastic or aluminum foil.

10. A method for converting a peripherally sealed, lay-flat, flexible, dispensing package to a self-supporting, stand-up configuration:

said package including an outer flexible wall structure defining a compartment containing fluidic material in an amount from about 50 to about 80% of the volume of said compartment with the remaining volume of said compartment having a vapor pressure below atmospheric pressure, said compartment having first and second portions with said fluidic material being disposed in said first portion;

said method comprising:

(a) displacing a substantial amount of said fluidic material from the first portion of said compartment to the second portion of said compartment; and (b) while maintaining fluidic material in the second portion of said compartment, inverting into said compartment the flexible wall substantially overlying the second portion and longitudinally opposite the first portion to form an inverted portion that defines an inverted inner wall, (c) whereby the confluence of said outer flexible wall with said inverted inner wall forms a self-supporting rim for up-right support of said package, and (d) wherein the outer flexible wall and the inverted inner wall of the self-supporting package are in spaced relationship and there is no flattening of the inverted portion due to the load of the fluidic material in the self-supporting mode.

11. The method of claim 10 wherein the fluidic material in said compartment is present in an amount from about 50 to about 65% of the volume of said compartment with the remaining volume of said compartment having a vapor pressure substantially below atmospheric pressure.

12. The method of claim 10 wherein the peripherally sealed lay-flat, flexible, dispensing package is a pillow-pack pouch.

13. The method of claim 10 wherein the peripherally sealed lay-flat, flexible, dispensing package is a four-side seal pouch.

14. The method of claim 10 wherein the peripherally sealed, lay-flat, flexible, dispensing package is a three-seal pouch.

15. The method of claims 10, 11, 12, 13 or 14 wherein the outer end of the first portion of the package has an inclined configuration that is adapted to provide a pour spout.

16. The method of claim 10 wherein the displacing of said fluidic material is effected through a manual squeezing force applied to the first portion of said compartment.

17. The method of claim 10 wherein the inverting of the flexible wall is effected through a manual depressing force applied to said wall.

18. The method of claim 10 wherein the displacing of said fluidic material and the inverting of the flexible wall is effected through mechanical means.

19. The method of claim 10 wherein the flexible wall has an inner face of heat sealable material and an outer face.

20. The method of claim 19 wherein the outer face comprises cellophane, paper, plastic, metalized plastic or aluminum foil.

* * * * *